US005078043A

United States Patent [19]

Stephens

[11] Patent Number: 5,078,043

[45] Date of Patent: Jan. 7, 1992

[54] SILENCER

[76] Inventor: Mark L. Stephens, 9478 Valley View, Alta Loma, Calif. 91701

[21] Appl. No.: 552,319

[22] Filed: Jul. 13, 1990

Related U.S. Application Data

[62] Division of Ser. No. 347,766, May 5, 1989, Pat. No. 4,977,815.

[51] Int. Cl.[5] ..... F41A 21/30

[52] U.S. Cl. ..... 89/14.4; 181/223

[58] Field of Search ..... 89/14.4; 181/223

[56] References Cited

U.S. PATENT DOCUMENTS 1,000,702 8/1911 Thurler ..... 89/14.4
3,713,362 1/1973 Charron ..... 89/14.4

FOREIGN PATENT DOCUMENTS 151375 11/1937 Austria ..... 181/223
341083 6/1936 Italy ..... 89/14.4
581974 10/1946 United Kingdom ..... 89/14.4

OTHER PUBLICATIONS

Smith, Walter H. B., Pistols and Revolvers, "Breechblock", 1946, p. 607.

*Primary Examiner*—Stephen C. Bentley
*Attorney, Agent, or Firm*—Daniel L. Dawes

[57] ABSTRACT

A silencer is provided for a machine pistol which silencer minimizes abrasive or frictional contact between the ballistic fired through the silencer in order to extend silencer life. The silencer includes a series concentric screen baffles which are retained in two concentric tubes. In the inner tube, a plurality resilient wipes are provided to contact the ballistic fired through the silencer without allowing contact between any of screen baffles in the fired ballistic.

2 Claims, 6 Drawing Sheets

26
30
32
36
38
40
61
70
72
74
75
79
80
94
96
98
99
100a
100b
101
14
20
24

SILENCER

This is a division of application Ser. No. 07/347,766, filed May 5, 1989 now U.S. Pat. No. 4,977,815.

BACKGROUND OF THE INVENTION

1. Field of the Invention

The present invention relates to firearms and in particular to an automatic machine pistol using gas discharge for recoil buffering and the silencer for the same.

2. Description of the Prior Art

Fully automatic or semi-automatic machine pistols are well known in the art. The use of gas pressure in automatic firearms to retard blowback action or to retard bolt blowback is also generally known. Examples of such gas retardation can be found in Irwin, "Gas Locked Firearm," U.S. Pat. No. 3,990,346 (1976) and Destree, "Firearm," U.S. Pat. No. 1,834,021 (1931). In Irwin, gas which is present in a locking chamber 24, as best depicted in FIG. 2, acts as a buffer to retard the blowback action and to prevent the bolt from slamming in a fully recoiled position. Vent 17, which initially had been closed with the bolt in the forward position by crosspin 13, is exposed and allows the remaining gas to vent slowly into chamber 26 as the bolt comes to rest at the end of its cycle. Port 18 in arm 3 communicates with chamber port 26 to vent remaining gases to the atmosphere. The barrel is provided with a gas port 8 which Communicates with the barrel interior and locking chamber 7 depicted in FIG. 1.

Port 8 is preferably located immediately forward of the cartridge. The close proximity of port 8 to the cartridge or firing chamber provides for entry of gas from the fired cartridge through port 8 into gas locking chamber 7 as soon as possible. After firing the cartridge, the bolt will tend to be forced rearwardly by the cartridge case thereby opening the breech.

However, there is sufficient delay of rearward movement to the bolt due to its weight as well as due to recoil spring 12 that the bolt does not begin to move rearwardly until the bullet has cleared gas port 8. Gas from the exploded cartridge charge enters locking chamber 7 against surface of plate 4. This high pressure gas urges plate 4 into a forward position and thus arm 3 maintains bolt 1 in a locked forward position until the projectile has left the muzzle and allowed the gas pressure to drop.

When the gas pressure in the barrel of the locking chamber has decreased sufficiently, the rearward momentum of the cartridge case against the forward bolt surface causes the bolt to be driven rearwardly. As the bolt nears its rearward position as shown in FIG. 2, plate 4 passes over and closes port 8 trapping and compressing the remaining gas in rear portion 24 of the gas locking chamber to cushion the movement of the bolt as it reaches the end of its rearward travel. Thus, gas present in locking chamber 24 acts as a buffer or air valve to retard blowback action and to prevent the bolt from slamming into its fully recoiled position.

However, in Irwin, discharge gas from the fired cartridge which has thus been used to retard blowback is then exhausted to the atmosphere through the gun casing generally, namely through any one of the many apertures, seams or openings which may be in communication directly or indirectly with gas locking chamber 24. This discharged gas is heavily laden with carbon, unburnt powder, and other small particles or products from the powder detonation. While some of these particles do escape with escaping gas to the environment, a significant fraction of them are deposited on any of the surfaces within the gun with which the discharge gas comes in contact. While such powder residue from a single shot is not excessive, the buildup of residue over a plurality of fired cartridges becomes excessive, particularly when the cartridges are rapidly fired as in an automatic weapon.

One of the persistent and unsolvable problems faced by small compact machine pistols has been due to fouling caused by excessive residue buildup which ultimately interferes with or jams operation of the gun. The resulting propensity of such machine pistols to become jammed has generally made them unreliable and unacceptable for military or police applications.

Therefore, what is needed is a simple, compact design for an automatic machine pistol which is not subject to the defects of the prior art as discussed above.

BRIEF SUMMARY OF THE INVENTION

The invention is an automatic machine pistol comprising a body including a barrel and barrel block. A bolt reciprocates within the body and with respect to the barrel and barrel block. A bleed port is defined through the barrel block to allow a predetermined degree of gaseous communication from the barrel through the bleed port. A gas port tube is fixed with respect to the body and is in gaseous communication with the bleed port for receiving gas from the barrel and directing the gas forwardly within the pistol. A receiving bore is defined in the bolt for telescopically receiving the gas port tube therein as the bolt reciprocates with respect to the body and gas port tube, which is fixed with respect to the body.

As a result, a portion of high pressure gas is bled from the barrel through the bleed port and into the gas port tube and into receiving bore within the bolt to resist recoil of the bolt upon firing of the pistol.

The pistol further comprises an upwardly directed nozzle coupled to and communicating with the receiving bore within the bolt. The nozzle is adapted to direct high pressure gas delivered to the receiving bore upwardly out of the pistol and to generate a reactive force resisting muzzle climb.

The pistol further comprising a plurality of roller bearings. The bolt is reciprocatingly retained within the body by the plurality of roller bearings.

The body comprises a plurality of rails. One of the plurality of roller bearings rides on a corresponding one of the plurality of rails. The bolt reciprocates within the body and is retained therein by the roller bearings in rolling engagement with the rails.

The bolt is a generally rectangular parallelopiped and is provided at each corner of the rectangular parallelopiped with a roller bearing. The plurality of rails comprises four longitudinally extending rails. Two of the roller bearings engages and rolls upon each one of the four rails.

The body further comprises a receiver housing. The receiver housing is pivotally coupled to the body and opens to allow substantially full access to the bolt without disassembly of the pistol.

The pistol further comprises a magazine for holding the plurality of ammunition rounds. The magazine comprises a mechanism for providing an injection force on the plurality of rounds tending to force the rounds into the bolt. The mechanism provides for a graduated force which increases stepwise as the magazine is filled with the plurality of rounds.

The mechanism for providing an injection force to the plurality of rounds comprises a plurality of compression springs and a mechanism for sequentially compressing selected ones of the plurality of the compression springs to generate the stepwise increase of the injection force.

The pistol further comprises a silencer for silencing the discharge sound of a ballistic fired through the silencer. The silencer comprises an inner and outer tube. The inner tube is concentrically disposed within the outer tube. A first baffle mechanism for reducing sound is disposed within the outer tube and outside the inner tube. A second baffle mechanism for reducing sound is disposed within the inner tube. A plurality of wipes is disposed within the inner tube for contacting the ballistic of the round of ammunition discharged through the silencer at a corresponding predetermined plurality of locations. The ballistic contacts only the plurality of wipes.

The first and second baffle mechanism is a stacked array of screen disks. Each screen disk has an axial bore defined therethrough. The inner diameter of the axial bore of the screen disk of the first baffle mechanism is sized to conform to the outer diameter of the inner tube disposed through the stacked array of screen disks of the first baffle mechanism. The second baffle mechanism comprises a stacked array of screened disks. Each disk has an axial bore defined there through. The inner diameter of the axial bore of the disks of the second baffle mechanism is sized to be larger than the ballistic.

The invention can also be characterized as an improvement in an automatic machine pistol for firing a plurality of ammunition rounds. Each ammunition round has a ballistic. The pistol has a body with a barrel for receiving each the round of ammunition and a bolt reciprocating respect to the body and the barrel. The bolt conveys one of the plurality of the ammunition rounds to the barrel for firing. The improvement comprises a pneumatic mechanism for generating a resistive force to recoil of the bolt when the ammunition round is fired in the barrel. A cleaning mechanism is included within the pneumatic mechanism and self-cleans the pneumatic mechanism upon discharge of each round of ammunition fired within the barrel. A muzzle mechanism is included within the pneumatic mechanism for generating a force resisting muzzle climb of the pistol when the plurality of ammunition rounds is fired from the barrel.

As a result, viable operation of the machine pistol is realized.

The pneumatic mechanism comprises a bleed port communicating with the barrel, a receiving bore defined in the bolt, and a gas port tube communicating with the bleed port and directing gas from the barrel through the bleed port forwardly within the pistol into the receiving bore defined in the bolt. The gas port tube and receiving bore are in telescopic relation to each other. A nozzle terminates the bore defined in the bolt to permit escape of gas through the nozzle with a predetermined resistance.

The cleaning mechanism comprises a mechanism for maintaining gas communicated from the barrel to the pneumatic mechanism at a high velocity while within the pneumatic mechanism to forcibly clean debris from the pneumatic mechanism.

The muzzle mechanism comprises an upwardly directed nozzle communicated with the pneumatic mechanism in a position within the pistol to generate a downward torque on the pistol to resist muzzle climb.

The invention is also a silencer for an automatic gun comprising a housing, a plurality of baffle mechanisms within the housing for absorbing acoustic energy, and a plurality of wipers disposed within the housing. The wipers are each adapted to contact a ballistic of a round fired from the gun at a predetermined and limited number of locations within the silencer. The ballistic contacting only the plurality of wipers within the silencer.

The baffle mechanism comprises an inner housing within the main housing, a first gas permeable labyrinth disposed between the main housing and inner housing, and a second gas permeable labyrinth disposed within the inner housing. The plurality of wipers is disposed within the inner housing.

The the plurality of wipers extend into a line of flight of the ballistic to circumferentially contact the ballistic. The second labyrinth, disposed within the inner housing, is offset from the line of flight by a predetermined distance greater than the radius of the ballistic.

The invention and its various embodiments are better visualized by viewing the following drawings.

The structural details in operation of the gun together with the various embodiments may be better understood by now turning to the following detailed description.

DETAILED DESCRIPTION OF THE PREFERRED EMBODIMENTS

An automatic machine pistol is provided, which is not subject to fouling, which is compact and light while incorporating a pneumatic recoil buffer, which resists muzzle climb, and which can be accessed and cleaned without disassembly. A silencer is provided for the machine pistol, which minimizes abrasives or frictional contact between the ballistic fired through the silencer to extend silencer life. The machine pistol is comprised of a reciprocating bolt within a housing of the pistol. The reciprocating bolt is carried within the housing on four rails by eight roller bearings. No sliding contact is made between the bolt and any other portion of the pistol. A portion of the high pressure gas from the barrel is bled through a bleed hole in the barrel block into a gas port tube which is telescopically inserted into the bolt. The gas port tube delivers the portion of the discharge gas in a forward direction in opposition to the bolt motion on recoil. An upwardly directed nozzle is communicated to the receiving bore within the bolt. The direction and force of the discharge gas within the gas port delivery tube and receiving bore within the bolt resist and buffers recoil, while the upwardly directed nozzle develops a downward thrust on the muzzle end of the pistol to avoid muzzle climb. The receiving cover pivotally opens to expose the entire bolt mechanism for cleaning without requiring disassembly of the pistol. The silencer includes a series of concentric screen baffles which are retained in two concentric tubes. In the inner tube, a plurality of resilient wipes are provided to contact the ballistic fired through the silencer without allowing contact between any of the screen baffles and the fired ballistic.

Figure 1:
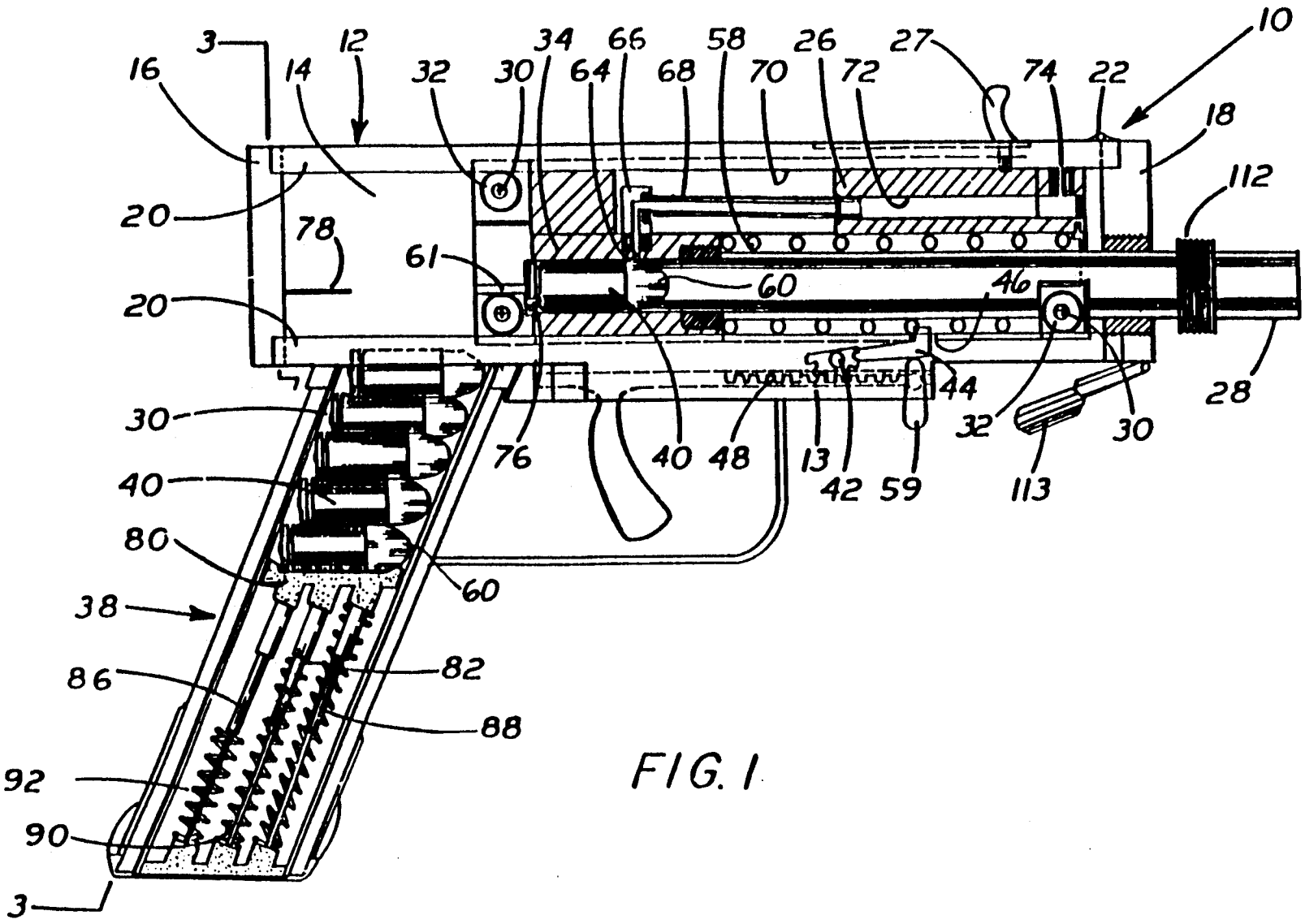
FIG. 1 is a diagrammatic cross sectional side view of the gun shown in its configuration just prior to firing.

FIG. 1 is a simplified cross sectional side view of an automatic machine pistol, generally denoted by reference numeral 10, devised according to the present invention. Pistol 10 is comprised of an upper receiver housing, generally denoted by reference numeral 12. Receiver housing 12 includes a structural framework comprised in turn of rear receiver plate 16 and front receiver plate 18 which are affixed through threaded bolts at each of the four corners of plates 16 and 18 to rails 20. The top and bottom left rails 20 are shown in the cross sectional view of FIG. 1 while all four rails 20 are depicted in the cross sectional end view of FIG. 3. Receiver housing also includes a base plate 13 which is fixed to or fixed relative to the bottom pair of rails 20.

A receiver housing cover 14 is rotatably coupled to front receiver plate 18 by means of hinge 22 and latched to rear receiver plate 16 by a latching mechanism, generally denoted by reference numeral 24, and better depicted and described in connection with FIG. 3 below.

Figure 2:
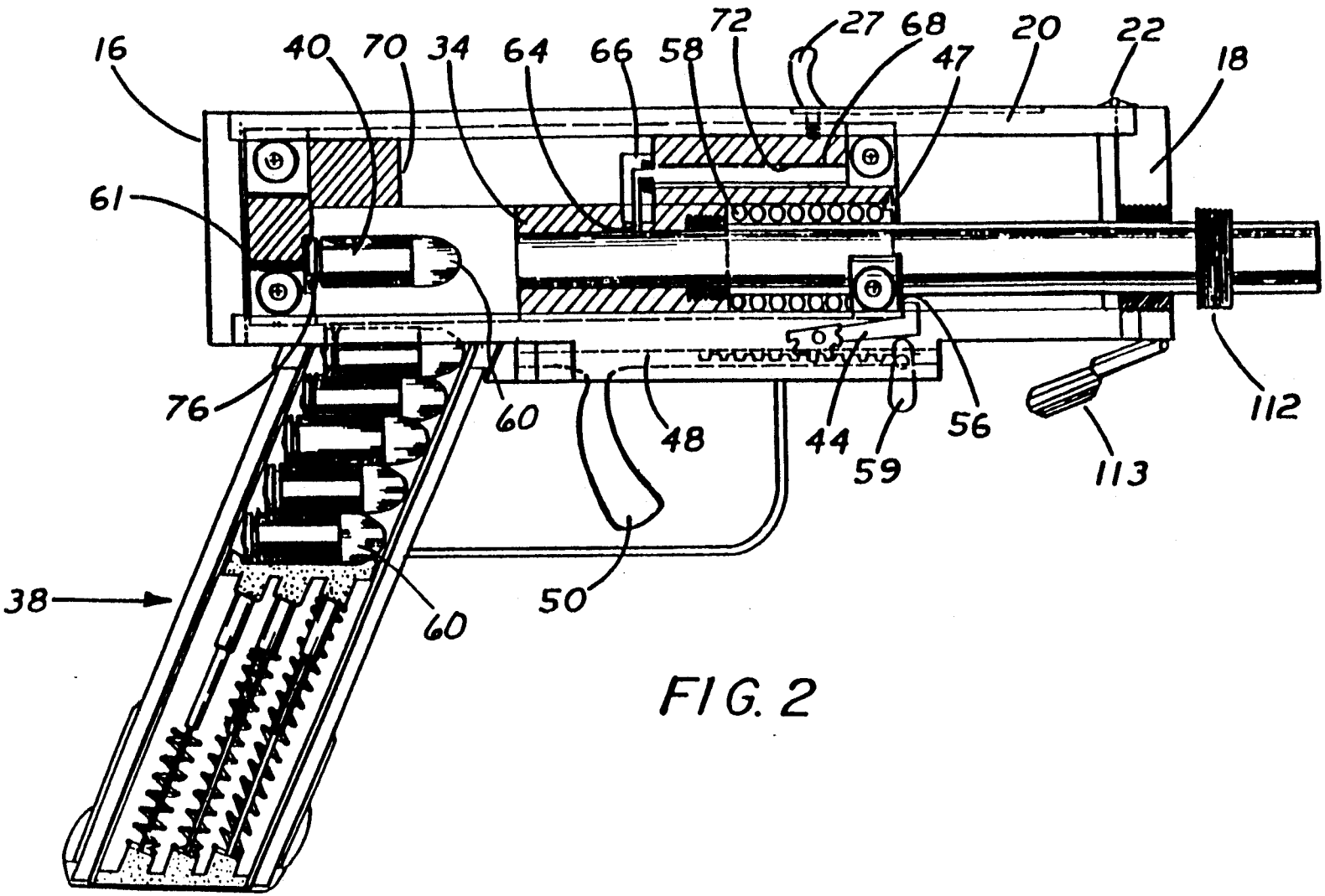
FIG. 2 is the cross sectional view of FIG. 1 of the gun in its full recoil or cocked position.
Figures 3, 3A, 5, 6, 6A:
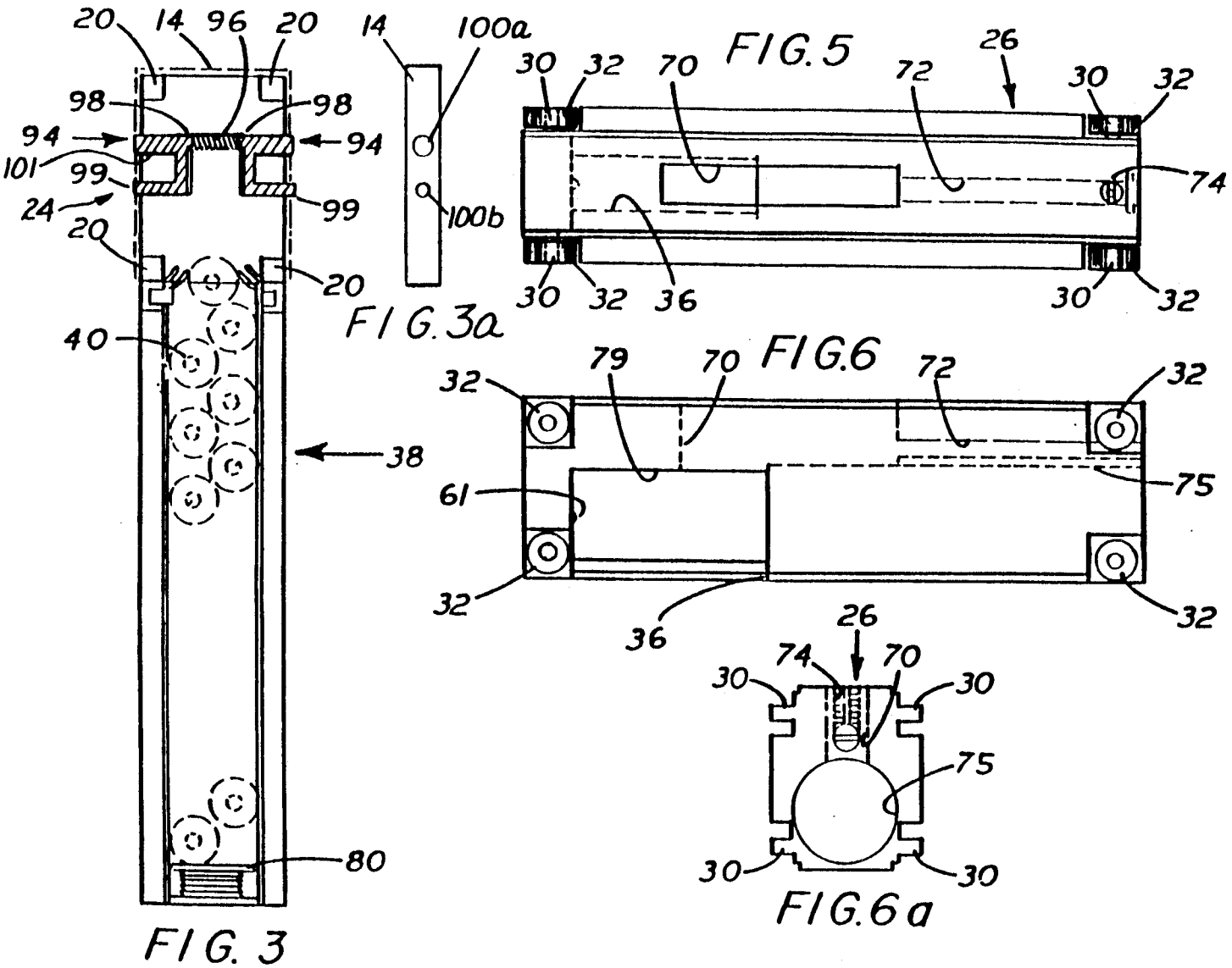
FIG. 3 is an in cross sectional view of the gun as seen through sectional lines 3—3 of FIG. 1.
FIG. 3*a* is a side view of the portion of the cover showing the locking holes depicted in FIG. 3.
FIG. 5 is a simplified top elevational view of the bolt of the gun of FIG. 1 with the remaining gun elements removed.
FIG. 6 is a simplified side elevational view of the bolt of the gun of FIG. 1 with the remaining gun elements removed.
FIG. 6*a* is simplified end elevational view of the bolt of FIG. 6 showing the cavity defined therein for the barrel and breech block.

Contained with receiver housing 14 is gun bolt 26 shown in cross sectional side view in FIGS. 1 and 2, and is better depicted in the top elevational view of FIG. 5, the side elevational view of FIG. 6, and the right end view of FIG. 6a. In each view the remaining elements of the gun mechanism have been removed for the sake of clarity to better illustrate the structure of just the bolt. Bolt 26 is a rectangular machined block which is provided with eight corner post axles 30 about which pivot eight corresponding roller bearings 32. Roller bearings 32 ride on or are coupled to rails 20, upper roller bearings 32 riding underneath upper rail 20 and lower roller bearing 32 riding on top of lower rail 20. The rolling engagement of bearings 32 with rails 20 have been shown only for the purposes of illustration and it must be understood that many other means of coupling or contact between rails 20 and roller bearings 32 may be used without departing from the spirit and scope of the invention.

Barrel 28 is fixed with respect to the gun body and is threaded or fixed to a breech block 34. Barrel block 34 is fixed to or fixed relative to base plate 13. A cocking handle 27 is connected or coupled to bolt 26 and allows the user to pull bolt 26 backwardly within gun 10 and in particular within receiver housing cover 14. A carrying ring 113 is also provided. Bolt 26 is pulled backwardly far enough to position opening 36 shown best in FIG. 5 in bolt 26 over magazine 38. As described in greater detail below, magazine 38 forces a round 40 into breech block 34.

Figure 4:
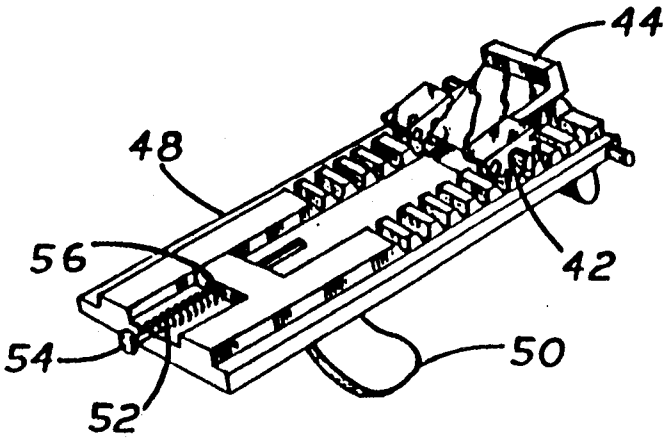
FIG. 4 is a perspective view of the trigger release mechanism of the gun shown in enlarged scale and in isolation from the remaining portions of the gun.

Sear gear 42 includes sear pin 44 which is disposed into a hole 46 defined in bolt 26 thereby securing bolt 26 in the safety position as best depicted in FIG. 1. Sear gear 42 is rotated on a rack and pinion gear rack 48 which extends rearwardly and integrally forms part of trigger 50 as better depicted in FIG. 4. A compression spring 52, retained in the illustrated embodiment on a pin 54, urges gear rack 48 together with integral trigger 50 forwardly within the gun. Pin 54 telescopically slides through bore 46 in gear rack 48 and is fixed at its opposing end to base plate 13. Therefore, compression spring 52 tends to urge sear 42 to rotate in a counterclockwise direction at all times with the result that when bolt 26 is fully retracted to the left, sear pin 44 will be urged upwardly into bore 46 of bolt 26 thereby securing bolt 26 in the cocked position.

Similarly, in the fully uncocked position as shown in FIG. 1, bolt 26 is retained within its rightmost position by engagement of sear pin 44 into bore 46 defined in bolt 26. Safety latch 59 is rotatably fixed to gear rack 48 and can be rotated as shown in FIG. 1 to jam sear pin 44 into bore 46 in the safety position. Therefore, even in this position when trigger 50 is squeezed backwardly tending to rotate sear 42 in a clockwise direction, rotation of sear 42 and movement of trigger 50 is prevented by contact between safety latch 59 and sear pin 44.

Turning again to the cocked position in FIG. 2, when trigger 50 is squeezed, sear gear 42 will rotate in clockwise direction, thereby disengaging sear pin 44 from edge 56 of bolt 26. This allows compression spring 58, which has its rightmost end fixed relative to bolt cap 47 and its leftmost end fixed relative to barrel block 34, to expand forcing bolt 26 forward. As bolt 26 begins to move to the right in FIG. 2, it will strip a round 40 from magazine 38 and carry round 40 to the position shown in FIG. 1. Round 40 is chambered into barrel block and is abruptly stopped causing a firing pin 61 on the inside rear surface of bolt 26 to detonate round 40.

The powder within round 40 explodes, forcefully ejecting bullet 60 down barrel 28 and thereby creating extremely high gas pressure within barrel 28 behind bullet 60. An equal and opposite force is applied to the spent cartridge and thus to bolt 26. This reactive force is resisted by the inertia of bolt 26 and the compressive force of recoil spring 58. However, the resistive force of the bolt's inertia and recoil spring 58 is not enough alone to prevent a forceful and undesirable blowback or kick.

Barrel block is therefore provided with a small bleed port 64 which communicates with a gas port block 66 fitted into breech block 34. Gas port block 66 in turn is connected to a telescopic gas port tube 68. Gas port block 66 and gas port tube 68 are disposed within a longitudinal bore 72 defined in bolt 26 as best depicted in the top elevational view of FIG. 5. Gas port tube 68 is telescopically disposed in longitudinal bore 72 defined within bolt 26 as illustrated in side sectional view of FIG. 1 and in top elevational view of FIG. 5. Gas port block 66 and gas port tube 68 are disposed within cavity 70 defined in bolt 26.

High pressure gas is then communicated from barrel 28 through bleed port 64, gas port block 66, gas port tube 68 and longitudinal bore 72 to a vertically directed gas nozzle 74. The forward motion and pressure of gas from barrel 28 delivered through gas block 66, and gas port tube 68 into longitudinal bore 72 serves to add a significant opposing and restraining force to the rearward motion of bolt 26.

Discharged gas ejected through nozzle 74 also creates a downward force on the end of bolt 26 thereby substantially counteracting the upward ride or muzzle climb of gun 10 during automatic fire.

Furthermore, the discharged gas is forced through bleed port 64, block 66, tube 68, bore 72 and nozzle 74 at high velocity. Most of the gas is thus ejected through nozzle 74 before it has slowed in velocity to degree sufficient to allow appreciable deposition of particulate matter out of the gas onto adjacent surfaces. Such particulate matter as may be deposited on the interior surfaces of bleed port 64, block 66, tube 68, bore 72 and nozzle 74 tends to be removed and blown out of the gun by the high velocity and force of the next gas discharge pulse. Therefore, the gas recoil system of the invention tends to be self-cleaning and resists fouling during sustained automatic firing.

Ultimately, bolt 26 will recoil to the leftmost position as shown in FIG. 2. Extractor claw 76 is fixed to rear portion of bolt 26 and attaches to the rim of spent cartridge of round 40 to pull it out of barrel block and to bring the cartridge forcibly rearward to hit ejector rod 78. Ejector rod 78 is slightly off center so that it hits the cartridge on one side, thereby canting and forcibly twisting or ejecting the cartridge from the gun through an ejection port 79 best shown in FIG. 6.

It should be noted that bolt 26 rides on rails 20 by means of roller bearings 32 and not through a sliding mechanism as is common in the prior art. Rolling instead of sliding friction is thus utilized by bolt 26 and there are no regions of close tolerance where grit and debris can lodge in the bolt action to cause jamming or undue friction. All surface wear is negligible as powder, dirt and grit on the bolt cannot present itself to or on any portion of the bolt mechanism as an abrasive grinding surface.

Bolt mechanism 26 rides freely on roller bearings 32 and can be easily opened by squeezing the latch mechanism 24 of FIG. 3 to unlock receiver housing cover 14 from the gun body. Receiver housing cover 14 is then swung upwardly, pivoting around hinge 22 coupled with front receiver plate 18. The interior of the entire bolt mechanism of gun 10 is then open and accessible for cleaning without requiring disassembly of the weapon.

As best depicted in FIG. 3, latch mechanism 24 comprised of two opposing and symmetrical C-shaped latch pins 94 which are pushed outwardly in opposite directions by compression spring 96 compressed and disposed between them. Each latch pin 94 includes an outwardly extending button portion 98 and a latching pin portion 99. Each latching pin 94 is captively retained within a conforming machined slot 101 by means of their C-shaped engagement with slot 101 and compression spring 96. A latching hole 100 is appropriately defined in receiver housing cover 14 to accept the outward extension of button 96 and latching pin 98. The user simultaneously depresses buttons 96 to force latch pins 94 towards each other and pulls upwardly on receiver housing cover 14 over depressed latch pins 94 to open receiver housing cover 14.

Receiver housing cover 14 is similarly rotated downwardly over latch pins 94 as latch pins 94 are simultaneously depressed. Continued rotation of receiver housing cover 14 ultimately allows latch pins 94 to snap outwardly through opening 100 defined in the side of receiver housing cover 14 thereby locking receiver housing cover 14 thereby locking receiver housing cover 14 in place.

One of the persistent problems with spring loaded magazines is that when the magazine is fully loaded, a great deal of force is exerted on the rounds to force them upwardly into the bolt. However, as the magazine is emptied the force exerted by the expanding springs decreases until at the furthest most extension of the springs, the last few rounds are to be fed to the bolt mechanism with the weakest force available from the magazine. In many cases, the force available to push the rounds into the bolt mechanism becomes insufficient or may have weakened over time. This defect is often remedied by providing a stiffer compression spring to provide a stronger injecting force at the end of the magazine feed, but then the force exerted by such a compression spring on the rounds, when the magazine is fully loaded, becomes excessive. Therefore the number of rounds that can be loaded within magazine 38 becomes limited and in many cases the prior art magazines are only partially filled for this reason.

Figure 2A:
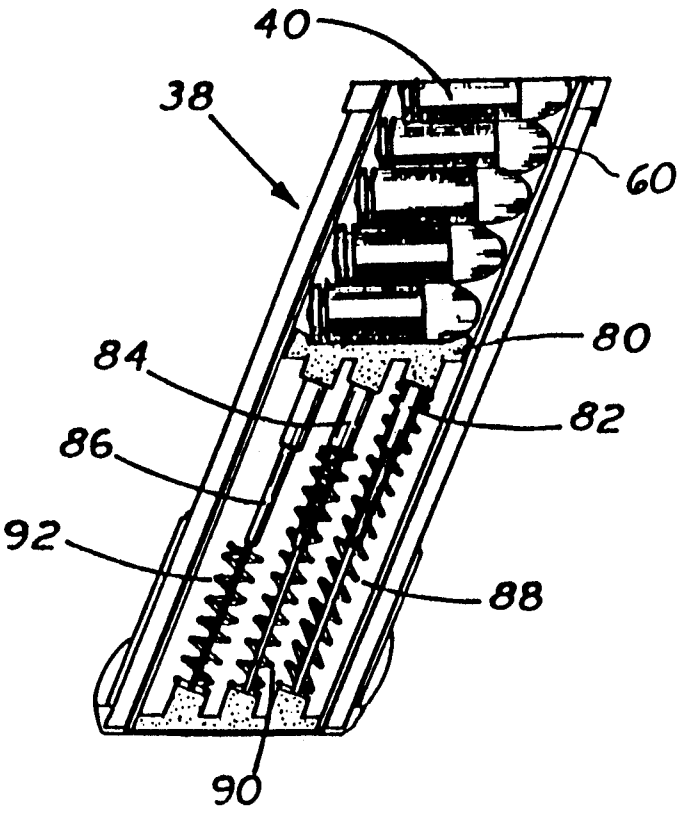
FIG. 2*a* is a simplified, partial cutaway view of the magazine of the gun of FIGS. 1 and 2 showing the spring feed mechanism in the magazine.

Turn now to magazine 38 as best depicted in FIGS. 1-3, and in particular in the cutaway side view of FIG. 2*a*. Rounds 40 are disposed within magazine 38 in a stacked offset two column array as best depicted in FIG. 3 in order to increase ammunition density and capacity within magazine 38. The bottom most round or rounds are in contact with a magazine follower 80, which is spring loaded by a plurality of springs disposed about and retained by corresponding telescopic rods. As shown in the side cross sectional view of FIG. 1, magazine follower 80 is provided with three sets of telescoping rods 82-86. Compression springs 88-92 are disposed concentrically on telescopic rods 82-86 respectively. In the illustrated embodiment, each rod 82-86 is in turn comprised of three telescopic rod segments with each rod segment longitudinally sliding within the next rod segment colinearly positioned above it.

Each of the coil springs 88-92 has a different spring constant and length. The spring constant of the shortest spring 88 is the greatest followed then by the spring constant of medium length spring 90, and then the longest spring with the lightest stiffness of all three, spring 92. By providing a plurality of springs of different spring constants and lengths, the injection force of the magazine may be maintained high near its fully unloaded configuration without producing an undue amount of injection force at the full configuration when the magazine is nearly full of rounds.

Thus, by making the spring with the heaviest spring constant, spring 82, shortest, and then lengthening the springs successively as their spring constants decrease, the amount of compression experienced by the springs with heavier spring constants is decreased for any given level of magazine follower 80 within magazine 38. For example, as magazine follower 80 is moved downwardly in magazine 38 as rounds 40 are loaded within the magazine, first the weakest spring 88 is compressed. Later when a predetermined point of loading capacity within magazine 38 is reached, spring 90 with a medium spring constant will begin to be compressed. Finally, when magazine 38 reaches an even more fully loaded configuration, heavy spring 92 will begin to be compressed. Therefore, as the amount of injection force required by magazine 38 increases, additional spring force is applied as properly needed according to the state of fullness of the magazine. Choice of a spring force sufficient to meet the nearly empty configuration of magazine 38 thus need not result in an excessive amount of spring force being applied to rounds 40 when magazine 38 is in its nearly full configuration.

Figure 7:
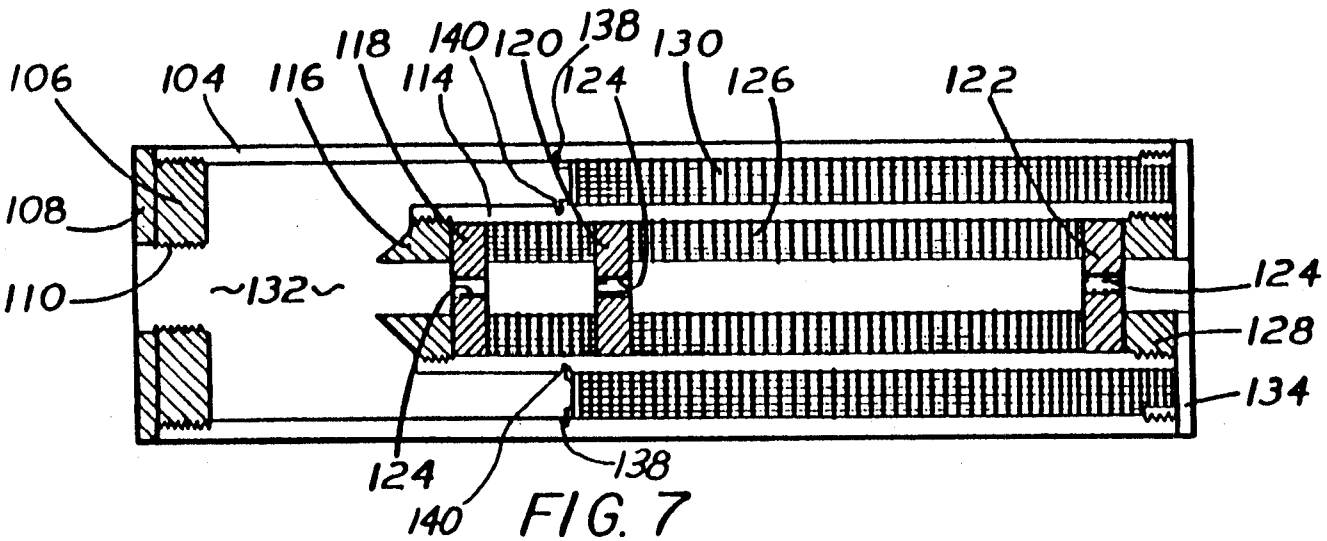
FIG. 7 is a cross-sectional view of a silencer of the invention usable with the gun of FIGS. 1–6.
Figure 9:
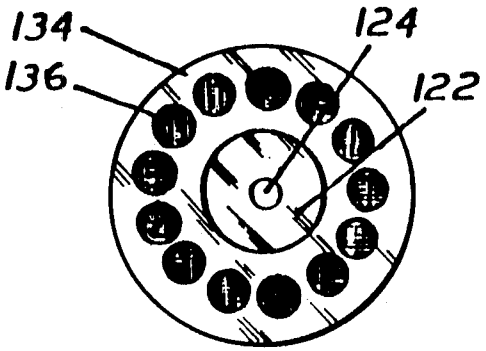
FIG. 9 is a plan view of the right end of the silencer of FIG. 7.
Figure 8:
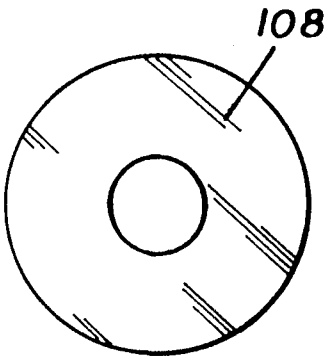
FIG. 8 is a plan view of the left end of the silencer of FIG. 7.
Figure 12:
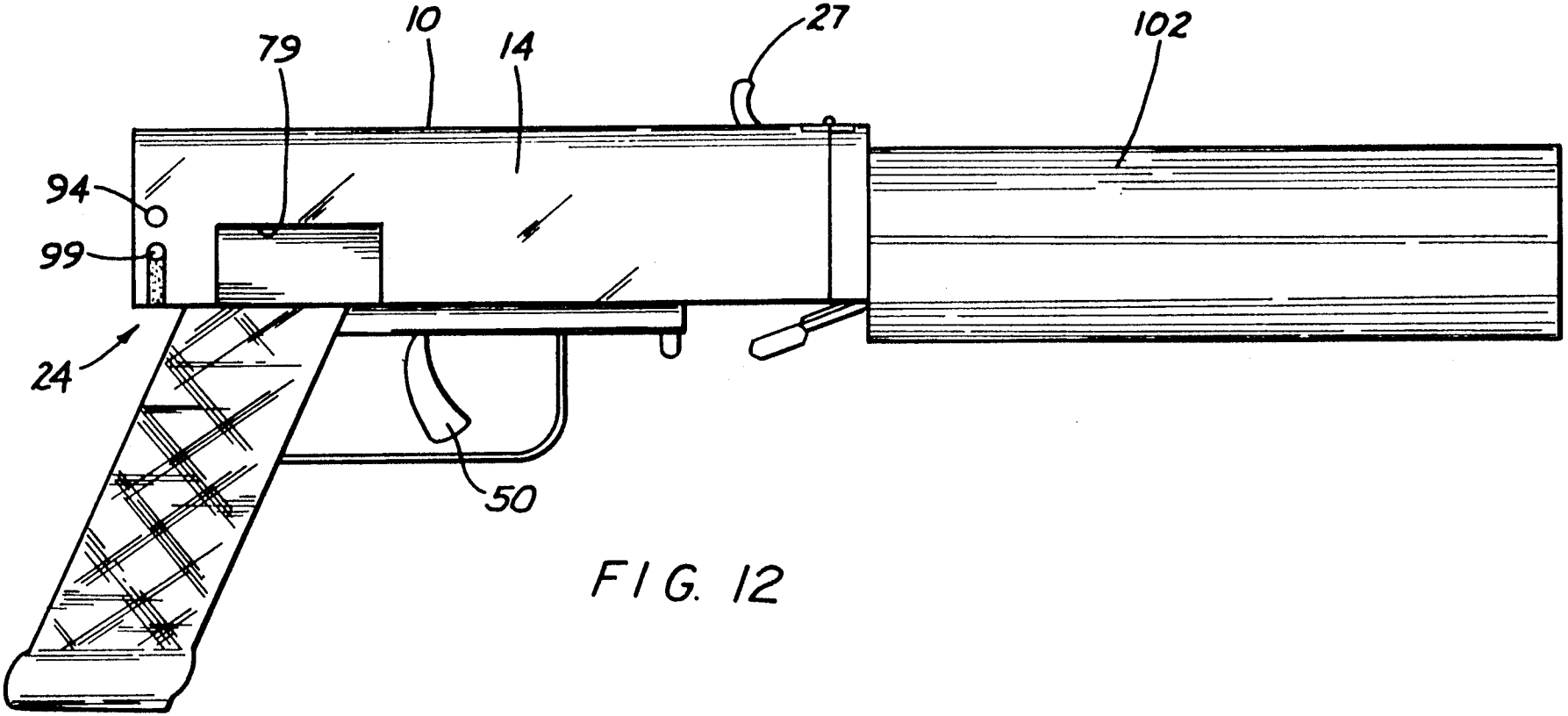
FIG. 12 is a side elevational view of the gun of FIG. 1–6 with the silencer of FIGS. 8–11.

Gun 10 is usable in combination with a silencer, generally denoted by reference numeral 102, of the embodiment of FIGS. 7–9. Silencer 102 as shown in cross sectional longitudinal view in FIG. 7 serves to baffle the sound and shock which would otherwise be heard. Silencer 102 is comprised of a cylindrical housing 104 connected to an inside tube end cap 106 as shown in the left-hand portion of FIG. 7. An outside tube end cap 108 is then affixed to inside tube end cap 106 to provide the finished end of silencer 102 which will fit against gun 10 and as will appear in an end view as shown in FIG. 9. End cap 106 is provided with internal threading 110 which is adapted to be coupled to silencer mount 112 provided on the end of barrel 28 as shown in FIG. 1.

Within tube 104 is an inner concentric tube 114. Inner tube 114 is coaxial with outer tube 104 and extends for a portion of the distance along the longitudinal length of tube 104. The left end of inner tube 114 is connected to a retaining cap 116. Retaining cap 116 is threaded to inner tube 114 and can be tightened thereon. Retaining cap 116 bears against the inner stack of wipes and screens inside inner tube 114. In the illustrated embodiment, a first resilient wipe 118 is placed immediately adjacent cap 116. Wipe 118, as is the case with the remaining wipes 120 and 122, are composed of a resilient material such as TEFLON, neoprene, or another rubber or plastic composition and are washer-like in shape with a central axial bore 124 through each. The inner diameter of bore 124 is slightly smaller than the caliber of bullet 60 which will pass from the left to the right through silencer 102.

Figure 10:
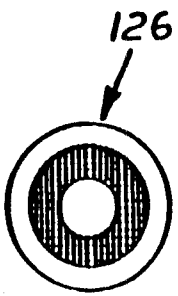
FIG. 10 is a plan view of a disk inside the inner tube of the silencer of FIG. 7.

Between wipes 116 and 120, and 120 and 122 are a plurality of stacked stainless steel screen disks, generally denoted by reference numeral 126. Again in the illustrated embodiment, 30 lines per inch screening is used within disks 126 and provide a labyrinth of baffles to slow the discharged gas velocity down and thereby decrease the sound of discharge. The right end of inner tube 114 is provided with a threaded termination cap 128 so that wipes 118–122 and screen disk 126 are snugly stacked and retained within inner tube 114 between caps 116 and 128. An end view of one of such disks 126 is illustrated in FIG. 10.

Figure 11:
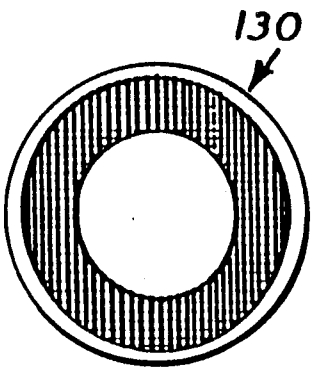
FIG. 11 is a plan view of a disk outside the inner tube of the silencer of FIG. 7.

Disposed between inner tube 114 and outer tube 104 is a second plurality of stacked screen disks 130, an end view of one of such disks shown in isolation is best depicted in FIG. 11. Outer screen disks 130 have a bronze copper screen of 20 lines per inch and used to muffle and cushion the plume or gas discharge shock wave. The left end of the stack of screen disks 130 is open to the interior 132 of outer tube 104 and provide a continuous baffled array of stacked disks to the right end of outer tube 104, which is fitted with an outside tube end cap 134. End cap 134 has a plurality of openings 136 defined there through as best depicted in the end view of FIG. 9, which allows pressure equalization and discharge through holes 136 to the stacked labyrinth of screen disks 130 within outer tube 104. Stacked array screen disks 130 are retained at their left end within outer tube 104 by split retaining rings 138 and 140, which are set within circumferential grooves machined into the inner surface of outer tube 104 and the outer surface of inner tube 114 as depicted in FIG. 7.

Thus the silencer of FIGS. 7–11 makes physical contact with bullet 60 only on three points, and in each of these points contact is made only with an abrasive resistant expansible wipe which resiliently returns to its initial configuration after passage there through of bullet 60. The primary sound baffling elements within silencer 102 do not come into contact with bullet 60 with the result that effective sound deadening for both the shock wave of the bullet and gas discharge is achieved without undue contact or wearing by the bullet on silencer 102. Therefore, the effective lifetime and performance of silencer 102 is improved over what it would have been, if a greater degree of contact with the bullet were made.

Many alterations and modifications may be made by those having ordinary skill in the art without departing from spirit and scope of the invention. Therefore, the illustrated embodiment has been set forth only for the purposes of example. Thus, the invention should not be read as limited by the description of its illustrated embodiments, but is defined in the following claims.

I claim:

1. A silencer for an automatic gun comprising:

a main housing;

a plurality of baffle means within said main housing for absorbing acoustic energy; and a plurality of wiper means disposed within said housing, adapted to contact a ballistic of a round fired from said gun at a predetermined and limited number of locations within said silencer, said ballistic contacting only said plurality of wiper means within said silencer;

wherein said baffle means comprises:

an inner housing concentrically disposed within said main housing;

a first gas permeable labyrinth disposed between said main housing and inner housing; and a second gas permeable labyrinth disposed within said inner housing, said plurality of wiper means disposed within said inner housing.

2. The silencer of claim 1 wherein said plurality of wiper means extend into a line of flight of said ballistic to circumferentially contact said ballistic, and wherein said second labyrinth disposed within said inner housing is offset from said line of flight by a predetermined distance greater than the radius of said ballistic.

* * * * *